US006065491A

United States Patent [19]

Rider

[11] Patent Number: 6,065,491

[45] Date of Patent: May 23, 2000

[54] BLIND ALIGNMENT SILLCOCK WITH NON-VIBRATING LOOSE WALL MOUNTING

[76] Inventor: Walter A. Rider, 2993 Jerusalem Rd., Pacolet, S.C. 29372

[21] Appl. No.: 09/086,682

[22] Filed: May 28, 1998

[51] Int. Cl.[7] ..... E03B 7/00; E03C 1/00

[52] U.S. Cl. ..... 137/360; 137/359

[58] Field of Search ..... 137/360, 801; 285/139.1, 139.2, 139.3, 46; 403/13, 11, 260, 258, 256

[56] References Cited

U.S. PATENT DOCUMENTS

| | | | |
|---|---|---|---|
| 753,974 | 3/1904 | Blauber | 285/46 |
| 809,720 | 1/1906 | Mueller | 285/46 |
| 3,971,401 | 7/1976 | Persson | 137/360 |
| 4,022,243 | 5/1977 | Edwards | 137/360 |
| 4,158,366 | 6/1979 | Van Meter | 137/312 |
| 4,212,319 | 7/1980 | Krablin | 137/614.2 |
| 4,314,580 | 2/1982 | Steinwand | 137/360 |
| 5,603,347 | 2/1997 | Eaton | 137/360 |

*Primary Examiner*—Denise L. Ferensic
*Assistant Examiner*—Kenneth B. Rinehart
*Attorney, Agent, or Firm*—Richard L. Miller, P.E

[57] ABSTRACT

A blind alignment sillcock with non-vibrating loose wall mounting. The sillcock includes a spout and water regulating handle assembly, a tube portion, and a wall mounting portion. The tube portion has a threaded portion with a keyway slot therein that extends at a position in line with a valve stem of the spout and water regulating handle assembly, and which provides a reference for assuring that the valve stem is properly facing up when the blind alignment sillcock with non-vibrating loose wall mounting is being fastened blindly from behind the wall. The wall mounting a portion includes a nut plate that has a nut that threadably receives the tube portion. The leading face of the nut plate has teeth for engaging the interior side of the wall. The nut has a plurality of keyway slots that extend radially outwardly, with each keyway slot being alignable with the keyway slot in the threaded portion of the tube portion. The wall mounting portion further comprises a key that engages one keyway slot in the nut and the keyway slot in the threaded portion of the tube portion when the nut plate is snugged up against the wall, with the teeth on the nut plate engaging the wall which prevents the nut plate from vibrating loose and likewise the tube portion which is affixed to the nut plate by the key.

9 Claims, 1 Drawing Sheet

FIG. 1
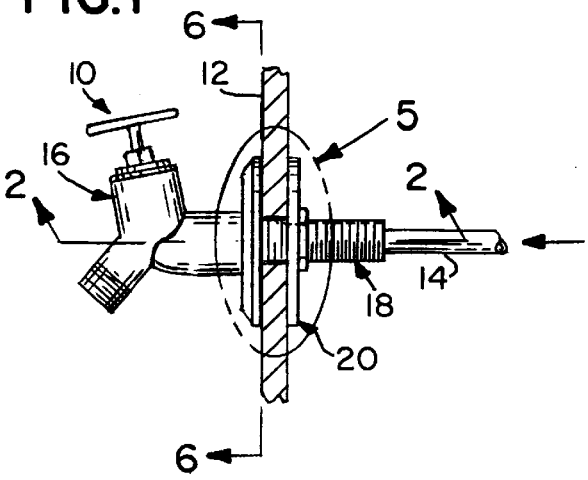
FIG. 5
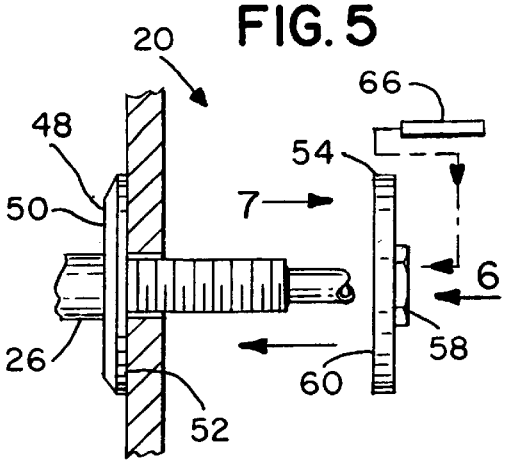
FIG. 7
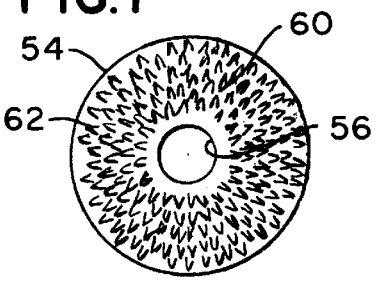
FIG. 3
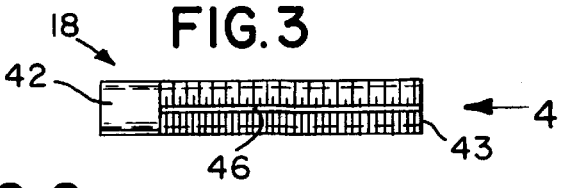
FIG. 6
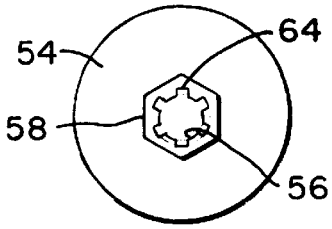
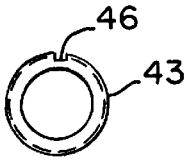
FIG. 4
FIG. 2
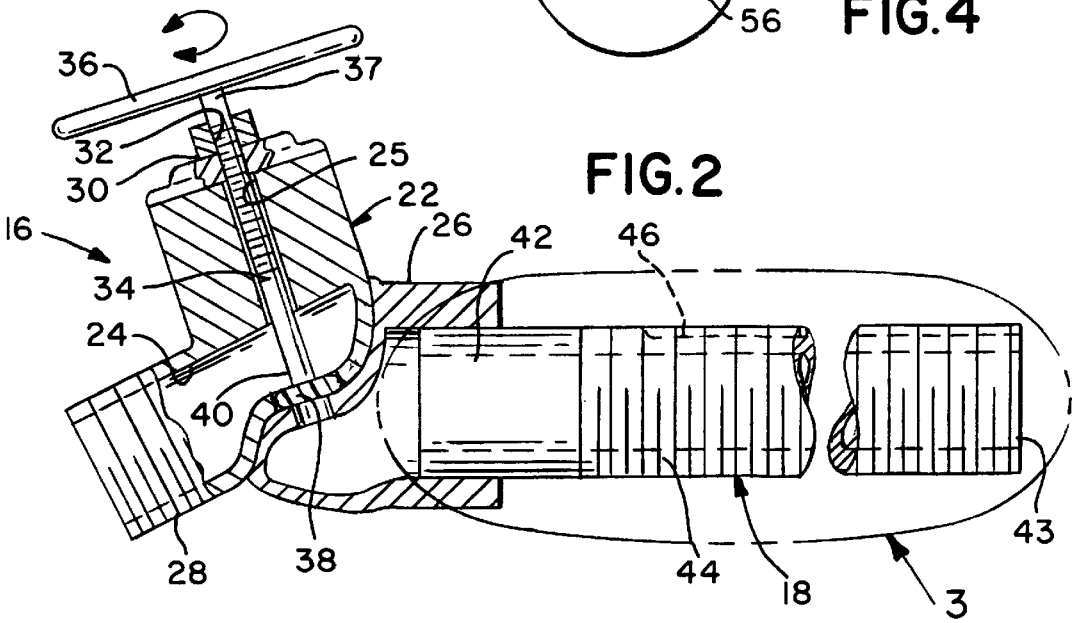

BLIND ALIGNMENT SILLCOCK WITH NON-VIBRATING LOOSE WALL MOUNTING

BACKGROUND OF THE INVENTION

1. Field of the Invention

The present invention relates to a sillcock. More particularly, the present invention relates to a blind alignment sillcock with non-vibrating loose wall mounting.

2. Description of the Prior Art

Numerous innovations for sillcocks have been provided in the prior art that will be described. Even though these innovations may be suitable for the specific individual purposes to which they address, however, they differ from the present invention.

FOR EXAMPLE, U.S. Pat. No. 3,971,401 to Persson teaches a sillcock intended to be mounted in a wall between a warm space and a cold space to provide a water flow passage through the wall and comprises a water flow pipe extending between the warm side and the cold side of the wall, a shut-off valve including a valve seat and an associated valve body, a valve control member disposed on the cold side of the wall and a valve control rod disposed within the water flow pipe and connecting the valve control member with the valve. The valve seat of the shut-off valve is located within the water flow pipe at a point along the pipe, which has a lowest temperature exceeding 0 degrees C., when the sillcock is mounted in a wall, and preferably at a point located between the warm side of the wall and the location of the zero isotherm within the wall.

ANOTHER EXAMPLE, U.S. Pat. No. 4,022,243 to Edwards teaches a frost proof sillcock having an outer section with a fluid chamber therein and a discharge opening, a round tubular body connected to the external section and communicating with the chamber, and a seat end section of substantially the same diameter as the tubular body connected integrally with the body to form a substantially even external surface between the body and the section. The seat end section contains a valve seat and a plurality of thread segments, and a stem extends through the chamber in the external section and through the body, and contains a valve element on the inner end thereof for seating on the seat. A hand wheel for rotating the stem to seat and unseat the valve element is secured to the outer end of the stem.

STILL ANOTHER EXAMPLE, U.S. Pat. No. 4,158,366 to Van Meter teaches a sillcock that includes an inner tubular pipe forming a water-flow passage and an outer tubular pipe cooperating with the inner tubular pipe to form a water relief chamber. When the inner tubular pipe is ruptured as a result of the expansion of ice in the inter-flow passage, water from the source is directed across the open valve of the sillcock into the water-flow passage where it escapes into the water relief chamber through the ruptured opening. The relief chamber is opened to the atmosphere and water emerging therefrom alerts a person to the fact that the inner tubular pipe has ruptured thereby requiring repair or replacement.

YET ANOTHER EXAMPLE, U.S. Pat. No. 4,212,319 to Krablin teaches an anti-backflow device for preventing fluids from flowing back into a water supply system. The device adapted for attaching to a connecting rod inside a sillcock tube of a standard antifreeze sillcock. The device held in an open position for allowing water to flow through the sillcock under normal operating conditions. The device automatically stopping the backflow of water in the sillcock should there be a loss of water pressure to the sillcock and preventing fluids such as insecticides, chemicals, or the like mixed with water from polluting the water system.

FINALLY, STILL YET ANOTHER EXAMPLE, U.S. Pat. No. 5,603,347 to Eaton teaches an improved leak guard for preventing damage to a building caused by a ruptured conventional sillcock, wherein the sillcock has a tube, a valve within the tube and a control knob at one end of the tube operably coupled with the valve. The leak guard includes a tubular connector interconnecting the tube of the sillcock and the supply line for establishing fluid communication therebetween and a housing sealingly secured to the connector. The housing has an internal chamber for receiving the tube of the sillcock when the sillcock is connected to the connector. Further, the housing has an outlet disposed to be located outside the building when the guard is installed for directing leaking water from the sillcock to a point outside the building.

It is apparent that numerous innovations for sillcocks have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Applicant has provided a sillcock that will not vibrate loose from the wall it is mounted through when the water is initially turned on and ultimately turned off.

The force created on the sillcock by the water initially being turned on and ultimately turned off can be considered as an instantaneous force of large magnitude, but of short duration, with a linear impulse of unity. VIBRATION ANALYSIS; Vierck; 1967.

Since the force acts for an instantaneous time only, the equation of motion are shown as equations 1 and 2 infra:

$$m\ddot{x} = -kx$$

$$\ddot{x} + \frac{k}{m}x = 0$$

If the mass m is at rest (so that $x=0=\dot{x}$ for $t<0$), and the unit impulse is imposed at $t=0$, the initial conditions at $t=0$ are:

$x=0$ $m\dot{x}=1$ $\dot{x}=1/m$

The condition $M\dot{x}=1$ is based upon equating the linear momentum change $M\dot{x}$ to the linear impulse of unity which is imposed at $t=0$.

The solution to the differential equation is shown as equation 3 infra:

$X=A \sin wt+B \cos wt$

Determining the arbitrary constants from the initial conditions results in equations 4 and 5 infra:

$$A = \frac{1}{m\omega} = \frac{1}{\sqrt{mk}}$$

and $$B = 0$$

so that by equation 6 infra:

$$x = \frac{1}{\sqrt{mk}} \sin\omega t = h(t)$$

The term h(t) is called either the impulse response or the response to a unit impulse, and it represents the response, or motion change, due to the unit impulse created initially when the water is turned on and ultimately turned off being imposed on the sillcock.

ACCORDINGLY, AN OBJECT of the present invention is to provide a blind alignment sillcock with non-vibrating loose wall mounting that avoids the disadvantages of the prior art.

ANOTHER OBJECT of the present invention is to provide a blind alignment sillcock with non-vibrating loose wall mounting that is simple and inexpensive to manufacture.

STILL ANOTHER OBJECT of the present invention is to provide a blind alignment sillcock with non-vibrating loose wall mounting that is simple to use.

BRIEFLY STATED, YET ANOTHER OBJECT of the present invention is to provide a blind alignment sillcock with non-vibrating loose wall mounting. The sillcock includes a spout and water regulating handle assembly, a tube portion, and a wall mounting portion. The tube portion has a threaded portion with a keyway slot therein that extends at a position in line with a valve stem of the spout and water regulating handle assembly, and which provides a reference for assuring that the valve stem is properly facing up when the blind alignment sillcock with non-vibrating loose wall mounting is being fastened blindly from behind the wall. The wall mounting portion includes a nut plate that has a nut that threadably receives the tube portion. The leading face of the nut plate has teeth for engaging the interior side of the wall. The nut has a plurality of keyway slots that extend radially outwardly, with each keyway slot being alignable with the keyway slot in the threaded portion of the tube portion. The wall mounting portion further comprises a key that engages one keyway slot in the nut and the keyway slot in the threaded portion of the tube portion when the nut plate is snugged up against the wall, with the teeth on the nut plate engaging the wall which prevents the nut plate from vibrating loose and likewise the tube portion which is affixed to the nut plate by the key.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic side elevation view of the present invention installed through a wall;

FIG. 2 is an enlarged diagrammatic cross sectional view taken on line 2—2 in FIG. 1 of the present invention;

FIG. 3 is a reduced diagrammatic top plan view of the area generally enclosed by the dotted ellipse identified by arrow 3 in FIG. 2 of the tube portion of the present invention;

FIG. 4 is an enlarged diagrammatic end elevational view taken generally in the direction of arrow 4 in FIG. 3;

FIG. 5 is an enlarged exploded diagrammatic side elevational view of the area generally enclosed by the dotted ellipse identified by arrow 5 in FIG. 1 of the non-vibrating loose wall mounting portion of the present invention;

FIG. 6 is an enlarged diagrammatic front elevational view taken generally in the direction of arrow 6 in FIG. 5 of the front face of the base portion of the non-vibrating loose wall mounting portion of the present invention; and FIG. 7 is an enlarged diagrammatic rear elevational view taken generally in the direction of arrow 7 in FIG. 5 of the rear face of the base portion of the non-vibrating loose wall mounting portion of the present invention.

LIST OF REFERENCE NUMERALS UTILIZED IN THE DRAWING

10 blind alignment sillcock with non-vibrating loose wall mounting
12 wall
14 water source pipe
16 spout and water regulating handle assembly for positioning outside wall 12
18 tube portion for extending through wall 12 and for connecting to water source pipe 14
20 wall mounting portion
22 spout body of spout and water regulating handle assembly 16
24 water flow passage in spout body 22 of spout and water regulating handle assembly 16
25 handle nut cap aperture in spout body 22 of spout and water regulating handle assembly 16
26 neck of spout body 22 of spout and water regulating handle assembly 16
28 spout pipe of spout body 22 of spout and water regulating handle assembly 16
30 handle nut cap of spout and water regulating handle assembly 16
32 aperture through handle nut cap 30 of spout and water regulating handle assembly 16
34 valve stem of spout and water regulating handle assembly 16
36 handle of spout and water regulating handle assembly 16
37 external end of valve stem 34 of spout and water regulating handle assembly 16
38 washer seal of spout and water regulating handle assembly 16 for selectively allowing water to flow from neck of body 22 of spout and water regulating handle assembly 16 to spout 28 of body 22 of spout and water regulating handle assembly 16 when handle 36 of spout and water regulating handle assembly 16 is turned
40 internal end of valve stem 34 of spout and water regulating handle assembly 16
42 leading end of tube portion 18
43 trailing end of tube portion 18 for attaching to, and communicating with, water source pipe 14
44 threaded portion of tube portion 18
46 keyway slot in threaded portion 44 of tube portion 18
48 escutcheon plate of wall mounting portion 20
50 leading face of escutcheon plate 48 of wall mounting portion 20
52 opposing trailing face of escutcheon plate 48 of wall mounting portion 20 for abutting against wall 12
54 nut plate of wall mounting portion 20
56 central throughbore through nut plate 54 of wall mounting portion 20
58 nut on nut plate 54 of wall mounting portion 20
60 leading face of nut plate 54 of the wall mounting portion 20 for abutting against wall 12

62 teeth on leading face 60 of nut plate 54 of wall mounting portion 20 for engaging wall 12

64 plurality of keyway slots in nut 58 on nut plate 54 of wall mounting portion 20

66 key of wall mounting portion 20

DETAILED DESCRIPTION OF THE PREFERRED EMBODIMENT

Referring now to the figures, in which like numerals indicate like parts, and particularly to FIG. 1, the blind alignment sillcock with non-vibrating loose wall mounting of the present invention is shown generally at 10 for mounting through a wall 12 and for connecting to a water source pipe 14.

The overall configuration of the blind alignment sillcock with non-vibrating loose wall mounting can best be seen in FIG. 1, and as such will be discussed with reference thereto.

The blind alignment sillcock with non-vibrating loose wall mounting 10 comprises a spout and water regulating handle assembly 16 for positioning outside the wall 12, a tube portion 18 that extends from the spout and water regulating handle assembly 16, through the wall 12, and for connecting to the water source pipe 14, and a wall mounting portion 20 that is associated with the tube portion 18.

The specific configuration of the spout and water regulating handle assembly 16 can best be seen in FIG. 2, and as such will be discussed with reference thereto.

The spout and water regulating handle assembly 16 comprises a spout body 22 having a water flow passage 24 therein and a handle nut cap aperture 25 that communicates with the water flow passage 24 in the spout body 22 of the spout and water regulating handle assembly 16.

The spout body 22 of the spout and water regulating handle assembly 16 comprises a neck 26 and a spout pipe 28 that communicates with the water flow passage 24 in the spout body 22 of the spout and water regulating handle assembly 16.

The spout and water regulating handle assembly 16 further comprises a handle nut cap 30 with an aperture 32 therethrough that is collinear with and communicates with the handle nut cap aperture 25 in the spout body 22 of the spout and water regulating handle assembly 16.

The spout and water regulating handle assembly 16 further comprises a valve stem 34 that extends through the aperture 32 in the handle nut cap 30 of the spout and water regulating handle assembly 16 and through the handle nut cap aperture 25 in the spout body 22 of the spout and water regulating handle assembly 16.

The spout and water regulating handle assembly 16 further comprises a handle 36 disposed on the valve stem 34 of the spout and water regulating handle assembly 16, at its external end 37 for rotation therewith, and a washer seal 38 disposed on the valve stem 34 of the spout and water regulating handle assembly 16, at its internal end 40 for selectively allowing water to flow from the neck 26 of the body 22 of the spout and water regulating handle assembly 16 to the spout 28 of the body 22 of the spout and water regulating handle assembly 16 when the handle 36 of the spout and water regulating handle assembly 16 is turned.

The specific configuration of the tube portion 18 can best be seen in FIGS. 2–4, and as such will be discussed with reference thereto.

The tube portion 18 is elongated and has a leading end 42 that is received in the neck 26 of the body 22 of the spout and water regulating handle assembly 16 for communication therewith, and a trailing end 43 for attaching to, and communicating with, the water source pipe 14.

The tube portion 18 further has a threaded portion 44 that extends substantially from the neck 26 of the body 22 of the spout and water regulating handle assembly 16 to the trailing end 43 of the tube portion 18.

The threaded portion 44 of the tube portion 18 has a keyway slot 46 therein that extends longitudinally along its entire length, at a position in line with the valve stem 34 of the spout and water regulating handle assembly 16, which provides a reference for assuring that the valve stem 34 of the spout and water regulating handle assembly 16 is properly facing up when the blind alignment sillcock with non-vibrating loose wall mounting 10 is being fastened blindly from behind the wall 12.

The specific configuration of the wall mounting portion 20 can best be seen in FIGS. 5–7, and as such will be discussed with reference thereto.

The wall mounting portion 20 comprises an escutcheon plate 48 that receives the tube portion 18, and has a leading face 50 that abuts against the neck 26 of the body 22 of the spout and water regulating handle assembly 16, and an opposing trailing face 52 for abutting against the wall 12, on its exterior side, which allows the escutcheon plate 48 to be snugly sandwiched between the neck 26 of the body 22 of the spout and water regulating handle assembly 16 and the wall 12 when the blind alignment sillcock with non-vibrating loose wall mounting 10 is mounted through the wall 12.

The wall mounting portion 20 further comprises a nut plate 54 that has a central throughbore 56 therethrough, and a nut 58 that circumvents the central throughbore 56 in the nut plate 54 of the wall mounting portion 20 and threadably receives the tube portion 18.

The nut plate 54 of the wall mounting portion 20 has a leading face 60 for abutting against the wall 12, on its interior side, when the blind alignment sillcock with non-vibrating loose wall mounting 10 is mounted through the wall 12.

The leading face 60 of the nut plate 54 of the wall mounting portion 20 has teeth 62 that extends axially therefrom, over its entire surface, for engaging the interior side of the wall 12.

The nut 58 on the nut plate 54 of the wall mounting portion 20 has a plurality of keyway slots 64 that extend radially outwardly from, and communicate with, its center, with each keyway slot of the plurality of keyway slots 64 in the nut 58 on the nut plate 54 of the wall mounting portion 20 extending towards a respective side of the nut 58 on the nut plate 54 of the wall mounting portion 20, and being alignable with the keyway slot 46 in the threaded portion 44 of the tube portion 18.

The wall mounting portion 20 further comprises a key 66 that engages one keyway slot of the plurality of keyway slots 64 in the nut 58 on the nut plate 54 of the wall mounting portion 20 and the keyway slot 46 in the threaded portion 44 of the tube portion 18 that is aligned with the one keyway slot of the plurality of keyway slots 64 in the nut 58 on the nut plate 54 of the wall mounting portion 20 when the nut plate 54 of the wall mounting portion 20 is snugged up against the wall, on its interior side, with the teeth 62 on the leading face 60 of the nut plate 54 of the wall mounting portion 20 engaging the interior side of the wall 12 which prevents the nut plate 54 of the wall mounting portion 20 from vibrating loose and likewise the tube portion 18 which is affixed to the nut plate 54 of the wall mounting portion 20 by the key 66 of the wall mounting portion 20.

It will be understood that each of the elements described above, or two or more together, may also find a useful application in other types of constructions differing from the types described above.

While the invention has been illustrated and described as embodied in a blind alignment sillcock with non-vibrating loose wall mounting, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A blind alignment sillcock with non-vibrating loose wall mounting for mounting through a wall and for connecting to a water source pipe, said sillcock comprising:

a) a spout and water regulating handle assembly for positioning outside a wall; said spout and water regulating handle assembly comprising:

i) a spout body having a water flow passage therein and a handle nut cap aperture communicating with said water flow passage in said spout body of said spout and water regulating handle assembly; said spout body of said spout and water regulating handle assembly comprising:

1) a neck; and 2) a spout pipe communicating with slid water flow passage in said spout body of said spout and water regulating handle assembly;

ii) a handle nut cap with an aperture therethrough being collinear with and communicating with said handle nut cap aperture in said spout body of said spout and water regulating handle assembly; and iii) a valve stem extending through said aperture in said handle nut cap of said spout and water regulating handle assembly and through said handle nut cap aperture in said spout body of said spout and water regulating handle assembly;

b) a tube portion extending from said spout and waters regulating handle assembly, through the wall, and for connecting to the water source pipe; said tube portion being elongated and having:

i) a leading end being received in said neck of said body of said spout and water regulating handle assembly for communication therewith, and a trailing end for attaching to, and communicating with, the water source pipe; and ii) a threaded portion extending substantially from said neck of said body of said spout and water regulating handle assembly to said trailing end of said tube portion; and c) a wall mounting portion associated with said tube portion.

2. The sillcock as defined in claim 1, wherein said spout and water regulating handle assembly further comprises a handle disposed on said valve stem of said spout and water regulating handle assembly, at its external end, for rotation therewith, and a washer seal disposed on said valve stem of said spout and water regulating handle assembly, at its internal end, for selectively allowing water to flow from said neck of said body of said spout and water regulating handle assembly to said spout body of said spout and water regulating handle assembly when said handle of said spout and water regulating handle assembly is turned.

3. The sillcock as defined in claim 1, wherein said wall mounting portion comprises an escutcheon plate that receives said tube portion, and has a leading face that abuts against said neck of said body of said spout and water regulating handle assembly, and an opposing trailing face for abutting against the wall, on its exterior side, which allows said escutcheon plate of said wall mounting portion to be snugly sandwiched between said neck of said body of said spout and water regulating handle assembly and the wall when said blind alignment sillcock with non-vibrating loose wall mounting is mounted through the wall.

4. The sillcock as defined in claim 1, wherein said threaded portion of said tube portion has a keyway slot therein that extends longitudinally along its entire length, at a position in line with said valve stem of said spout and water regulating handle assembly, and which provides a reference for assuring that said valve stem of said spout and water regulating handle assembly is properly facing up when said blind alignment sillcock with non-vibrating loose wall mounting is being fastened blindly from behind the wall.

5. The sillcock as defined in claim 4, wherein said wall mounting portion further comprises a nut plate that has a central throughbore therethrough, and a nut that circumvents said central throughbore in said nut plate of said wall mounting portion and threadably receives said tube portion.

6. The sillcock as defined in claim 5, wherein said nut plate of said wall mounting portion has a leading face for abutting against the wall, on its interior side, when said blind alignment sillcock with non-vibrating loose wall mounting is mounted through the wall.

7. The sillcock as defined in claim 6, wherein said leading face of said nut plate of said wall mounting portion has teeth that extends axially therefrom, over its entire surface, for engaging the interior side of the wall.

8. The sillcock as defined in claim 7, wherein said nut on said nut plate of said wall mounting portion has a plurality of keyway slots that extend radially outwardly from, and communicate with, its center, with each keyway slot of said plurality of keyway slots in said nut on said nut plate of said wall mounting portion extending towards a respective side of said nut on said nut plate of said wall mounting portion and being alignable with said keyway slot in said threaded portion of said tube portion.

9. The sillcock as defined in claim 8, wherein said wall mounting portion further comprises a key that engages one keyway slot of said plurality of keyway slots in said nut on said nut plate of said wall mounting portion and said keyway slot in said threaded portion of said tube portion that is aligned with said one keyway slot of said plurality of keyway slots in said nut on said nut plate of said wall mounting portion when said nut plate of said wall mounting portion is snugged up against said wall, on its interior side, with said teeth on said leading face of said nut plate of said wall mounting portion engaging the interior side of the wall which prevents said nut plate of said wall mounting portion from vibrating loose and likewise said tube portion which is affixed to said nut plate of said wall mounting portion by said key of said wall mounting portion.

* * * * *